US006050044A

United States Patent [19]

McIntosh

[11] Patent Number: 6,050,044

[45] Date of Patent: Apr. 18, 2000

[54] BUILDING BLOCK

[75] Inventor: Eric G. McIntosh, Vancouver, Canada

[73] Assignee: Kitsilano Industries Inc., Vancouver, Canada

[21] Appl. No.: 09/124,026

[22] Filed: Jul. 29, 1998

[51] Int. Cl.[7] ..... E04C 1/00; A63H 33/08

[52] U.S. Cl. ..... 52/591.1; 52/591.3; 52/592.6; 446/124; 446/125; 446/127

[58] Field of Search ..... 52/591.1, 591.3, 52/592.5, 592.6; 446/124, 125, 127, 128

[56] References Cited

U.S. PATENT DOCUMENTS

| | | | |
|---|---|---|---|
| D. 387,431 | 12/1997 | Tremblay . | |
| 460,177 | 9/1891 | Cook . | |
| 828,930 | 8/1906 | Cramption | 52/591.1 X |
| 868,838 | 10/1907 | Brewington . | |
| 964,160 | 7/1910 | Hammett . | |
| 979,913 | 12/1910 | Ault | 52/591.1 |
| 1,130,324 | 3/1915 | Owen . | |
| 1,531,542 | 3/1925 | Cogshall . | |
| 2,472,363 | 6/1949 | Blackinton . | |
| 2,619,829 | 12/1952 | Tatum . | |
| 2,800,743 | 7/1957 | Meehan et al. . | |
| 3,005,282 | 10/1961 | Christiansen . | |
| 3,148,477 | 9/1964 | Bjorn et al. . | |
| 3,305,982 | 2/1967 | Steele . | |
| 3,558,138 | 1/1971 | Lemelson . | |
| 3,791,090 | 2/1974 | Kniefel . | |
| 4,035,947 | 7/1977 | Burge . | |
| 4,516,364 | 5/1985 | Heider . | |
| 5,069,647 | 12/1991 | Zuviria . | |
| 5,226,275 | 7/1993 | Trahan | 52/592.6 |
| 5,365,714 | 11/1994 | Potvin . | |
| 5,527,201 | 6/1996 | Maddock . | |
| 5,653,621 | 8/1997 | Yao . | |

FOREIGN PATENT DOCUMENTS

| | | |
|---|---|---|
| 81482 | 8/1997 | Canada . |
| 81483 | 8/1997 | Canada . |
| 81484 | 8/1997 | Canada . |
| 81485 | 8/1997 | Canada . |

*Primary Examiner*—Carl D. Friedman
*Assistant Examiner*—Timothy B. Kang
*Attorney, Agent, or Firm*—Oyen Wiggs Green & Mutala

[57] ABSTRACT

A building block has connectors on its side walls comprising interlocking male and female dovetails for connecting blocks side-by-side, in addition to connectors on its upper and lower ends for connecting the blocks vertically. The building blocks also have mating ribs and grooves on the side walls to minimize twisting movement between horizontally attached blocks. The building blocks may be relatively small for use as toy building blocks or relatively large for use as construction blocks.

4 Claims, 4 Drawing Sheets

BUILDING BLOCK

TECHNICAL FIELD

This invention pertains to building blocks, and in particular to building blocks which are structured for connection both vertically, i.e. between adjacent courses of blocks, and horizontally.

BACKGROUND

Building blocks designed to be placed side-by-side in courses and having connectors on their upper and lower sides for attaching blocks in adjacent courses together, are known in the art. For example, in the toy building block art, LEGO (trademark) blocks have mating posts and recesses on their top and bottom sides respectively for attachment of blocks in vertically adjacent courses, as shown in U.S. Pat. No. 3,005,282 Christiansen. Since such blocks do not have any side connecting means, it is not possible to attach them side-by-side in a single layer, in order to create a span, for example to construct a horizontal roof or beam. Blocks having side connecting means are known, but they are adapted only to attach blocks horizontally that are also connected vertically, and are not adapted to construct weight-bearing horizontal structures.

SUMMARY OF THE INVENTION

The invention provides a building block having novel side connecting means for attaching blocks side-by-side in a manner permitting the construction of weight-bearing spanning structures. The building blocks of the invention are adapted for use both as toy building blocks and as full-size construction blocks, for use in, for example, the construction of garages, sheds, etc. In this application, "building block" accordingly includes both relatively small blocks for use as toys and relatively large blocks for use in construction. The blocks according to the invention have conventional upper and lower connecting means, such as LEGO block-type posts and recesses, for connecting adjacent courses of blocks together. According to a preferred embodiment of the invention, the side connecting means are mating male and female dovetails on opposed walls of the blocks which extend from the upper end of the block partway down its side. The dovetails of adjacent blocks interlock so as to attach the blocks together side-by-side.

Preferably, the blocks also have a pair of mating ribs and grooves on each side wall which assists in stabilizing the block against twisting motion as between adjacent horizontally-connected blocks.

DESCRIPTION

Figure 1:
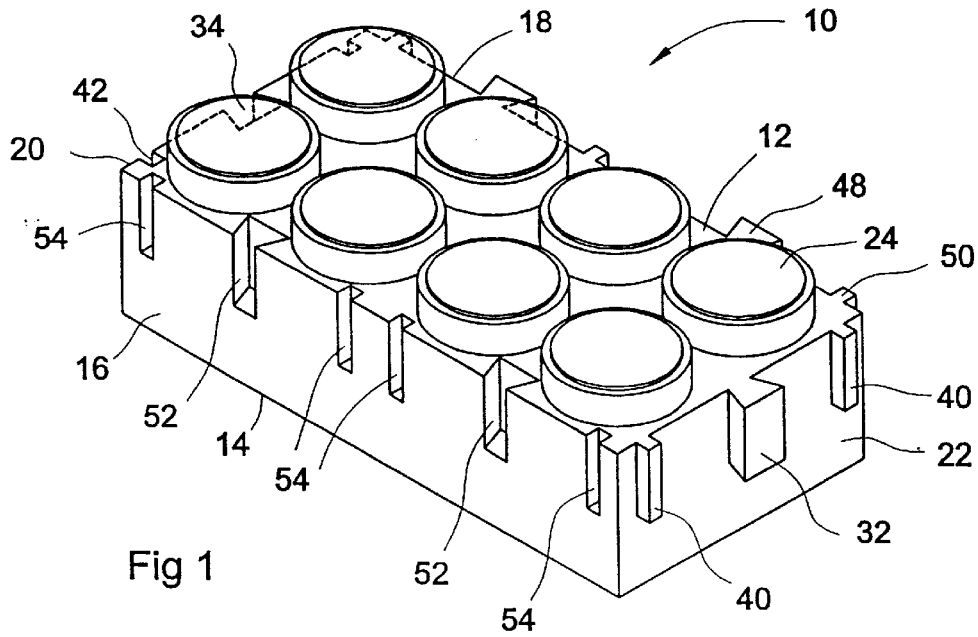
FIGS. 1 and 2 are perspective views of a building block according to the invention.
Figure 2:
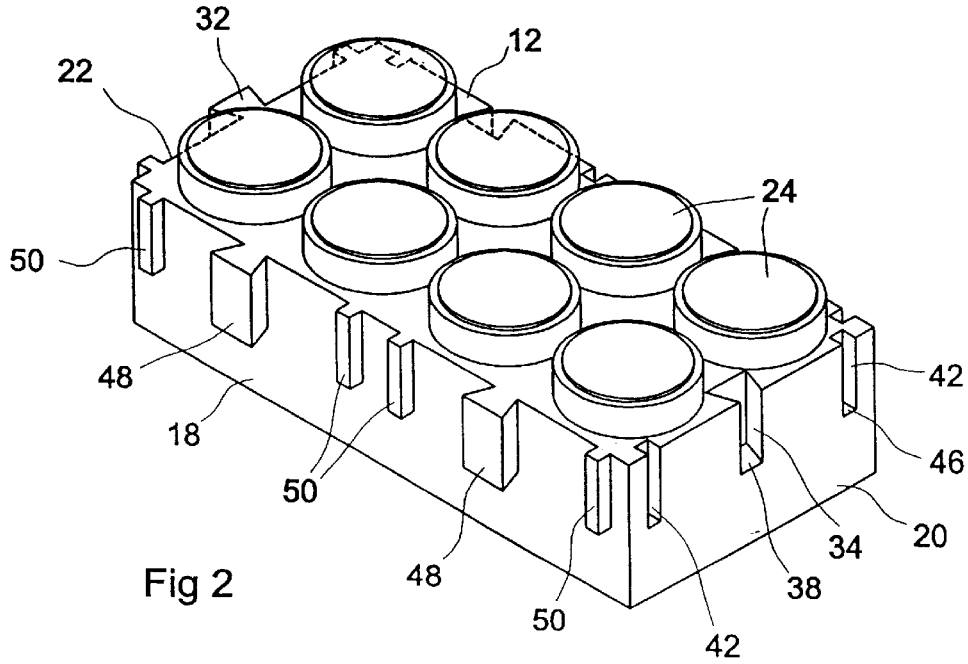

Referring to FIGS. 1 and 2, a building block 10 has a generally parallelepiped configuration, having an upper end 12, lower end 14, and four vertical side walls, namely two long side walls 16, 18 and two short side walls 20, 22, which are half the length of the long side walls.

Figure 3:
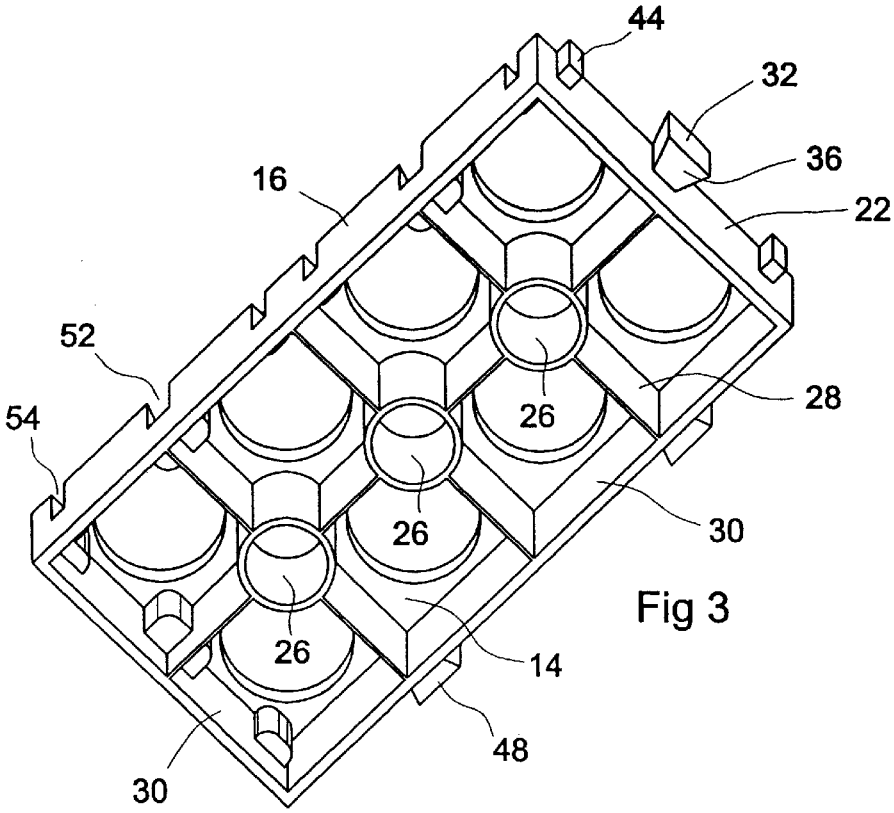
FIG. 3 is a perspective view of a building block of FIGS. 1 and 2 from its lower side.

The block 10 has connecting means at its upper and lower ends for connecting vertically adjacent courses of blocks together which is essentially the same as that used for LEGO blocks. Upper end 12 has eight posts 24 which are squat and cylindrical in shape and are sized and spaced so as to connect in a press fit with recesses in the lower end of the block. Referring to FIG. 3, three hollow cylindrical projections 26 extend vertically downward to the plane formed by the lower edge of the side walls of the block. Web elements 28 extend between the respective cylindrical projections 26 and between the cylindrical projections 26 and the inner surfaces 30 of the side walls 16, 18, 20, 22. The cylindrical projections 26 and the inner surfaces 30 of the side walls together form receptacles to receive and hold posts 24, in order to hold two vertically adjacent blocks, or blocks in two vertically adjacent courses of blocks, together. It will be apparent from FIG. 3 that the block 10 has eight such recesses, sized to snugly hold posts 24 of a block.

Side wall 22 of block 10 has male dovetail 32, i.e. a dovetail rib, in the center thereof, extending from top end 12 about halfway down the side wall 22. Opposed side wall 20 has female dovetail 34, i.e. a dovetail groove, in the center thereof, extending about halfway down the side wall 20. The female dovetail 34 is the same height as the male dovetail 32, and the male and female dovetails are of a mating size and configuration such that male dovetail 32 can slide into and fit snugly within female dovetail 34 of an adjacent block, with lower wall 36 of male dovetail 32 abutting lower wall 38 of female dovetail 34 when the male and female dovetails are interconnected and the top ends 12 of the horizontally connected blocks are at the same level.

A pair of ribs 40 protrude from side wall 22, one on either side of male dovetail 32, and extend vertically from the top end 12 about halfway down the side wall 22. Ribs 40 are rectangular in cross-section. Opposed side wall 20 has a pair of grooves 42 therein, extending about halfway down the side wall 20 and being of the same height as ribs 40. The ribs 40 and grooves 42 are of a mating size, position and configuration such that ribs 40 can slide into and fit snugly within grooves 42 of an adjacent block, with lower wall 44 of ribs 40 abutting lower wall 46 of grooves 32 when the ribs 40 and grooves 42 are interconnected, and with the male dovetail 32 and female dovetail 34 of the adjacent blocks being connected.

Opposed side walls 16 and 18 have a similar arrangement of male and female dovetails, ribs and grooves, except that since side walls 16, 18 are twice the length of side walls 20, 22, side wall 18 is provided with two male dovetails and four ribs and side wall 16 is provided with two female dovetails and four grooves. Specifically, side wall 18 has two male dovetails 48 thereon, identical in configuration to male dovetail 32, and two pairs of ribs 50, identical in configuration to ribs 40; and side wall 16 has two female dovetails 52, identical in configuration to female dovetail 34, and two pairs of grooves 54, identical in configuration to grooves 42. The spacing of each male dovetail 32, 48 and its accompanying pair of ribs 40, 50 respectively, and the spacing of each female dovetail 34, 52 and its accompanying pair of grooves 42, 54, is identical so that blocks 10 can interconnect by the attachment of a side wall 20 to a side wall 22, or by a side wall 18 to a side wall 16, or one or two blocks 10 can attach by a short side wall 20 or 22 to a long side wall 18 or 16 respectively.

Since ribs 40, 50 and grooves 42, 52 are rectangular in cross-section, and are oriented normal to the plane of their respective side walls, they do not interlock so as to prevent two attached blocks from becoming separated by a longitudinal pulling force. The function of ribs 40, 50 and grooves 42, 52 is to resist twisting movement between horizontally attached blocks. The extent to which such twisting could occur is in part determined by the size and configuration of male dovetails 32, 48 and female dovetails 34, 52. Where such male and female dovetails are relatively small, and the mating ribs and grooves are not present, a twisting force could cause some relative rotational movement of horizontally attached blocks. This is prevented by the presence of ribs 40, 50 and grooves 42, 52. It will be apparent that the relative twisting movement can also be reduced or prevented by other means, for example by having more than one dovetail connection between the blocks, or by increasing the dimensions of the dovetails.

Figure 4:
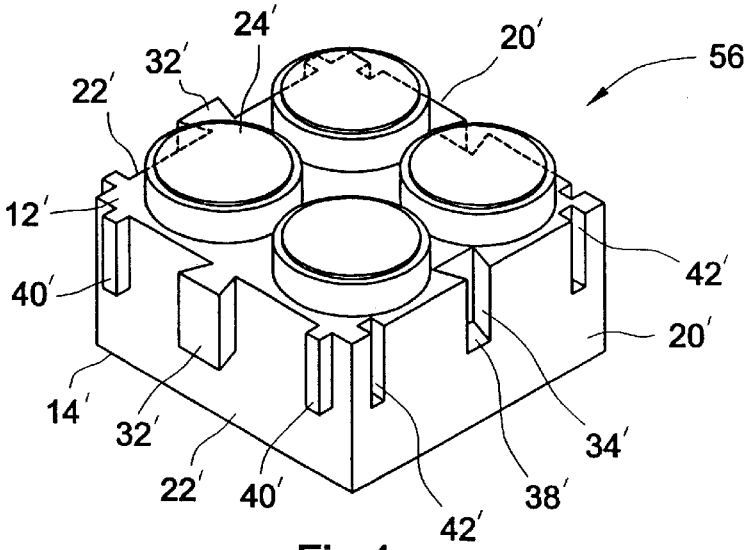
FIG. 4 is a perspective view of a half-length building block.
Figure 5:
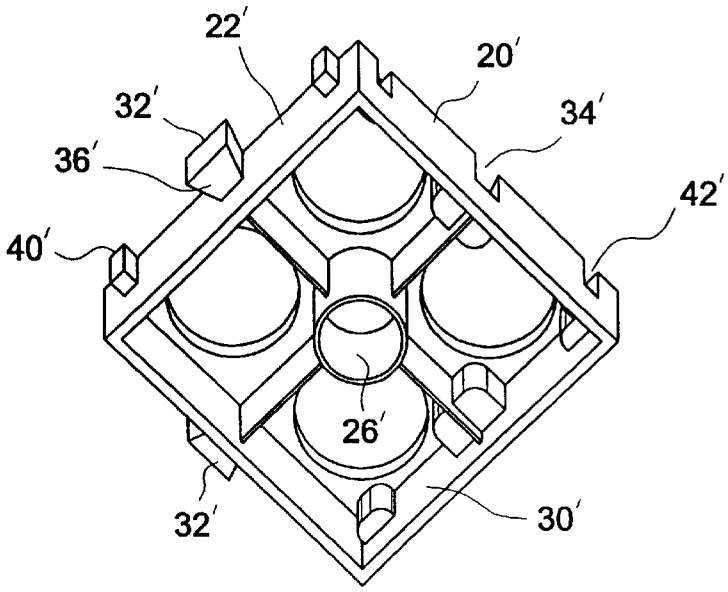
FIG. 5 is a perspective view of the half-length block of FIG. 4 from its lower side.

FIGS. 4 and 5 illustrate a half-length block 56, which is similar in structure to full length block 10 but is one-half its length. Block 56 is made to interfit with block 10 and is square in plan view with sides equal in length to the short sides 20, 22 of block 10. In the following description, elements of block 56 corresponding to like elements of block 10 are identified by the same numbers marked by a prime. Block 56 has upper end 12', bottom end 14' and two pairs of opposed side walls 20', 22'. There are four posts 24' on the upper end 12' of the block 56, and a single cylindrical projection 26' on the lower side, which, with the inner surfaces 30' of the side walls, forms four recesses to receive posts 24' of another block 56, or posts 24 of a block 10. The side connecting means comprises male dovetails 32' and female dovetails 34', and paired ribs 40' and grooves 42', which attach a block 56 to another block 56 or to a full-length block 10, in the same manner as described above with respect to the attachment of two full-length blocks 10.

Figure 6:
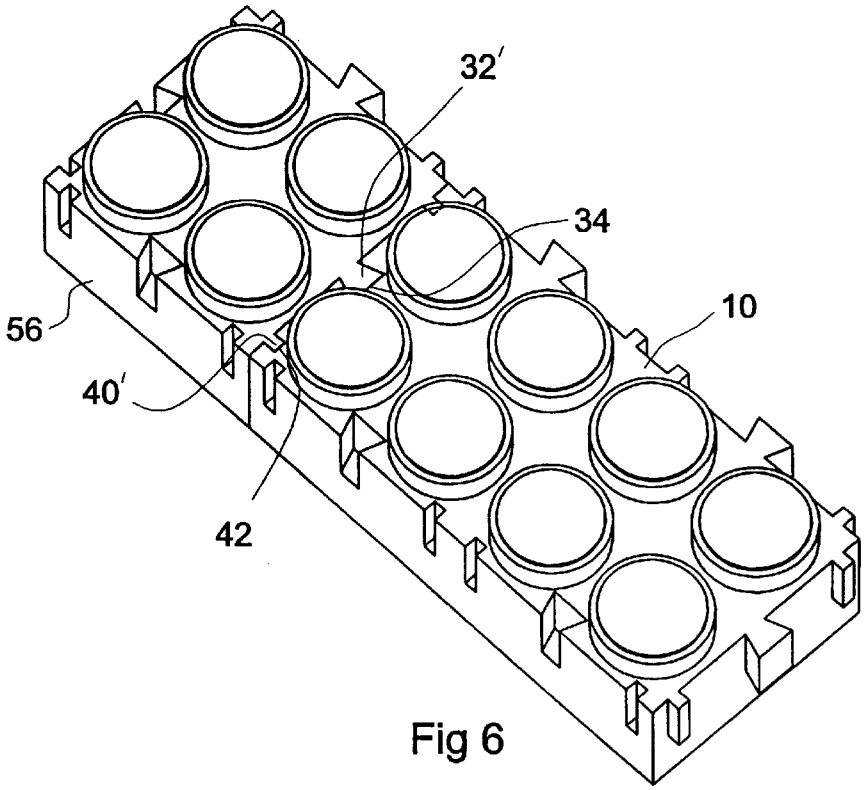
FIG. 6 is a perspective view on the longitudinal mid-line of the blocks of FIGS. 1 and 4 connected together horizontally.
Figure 8:
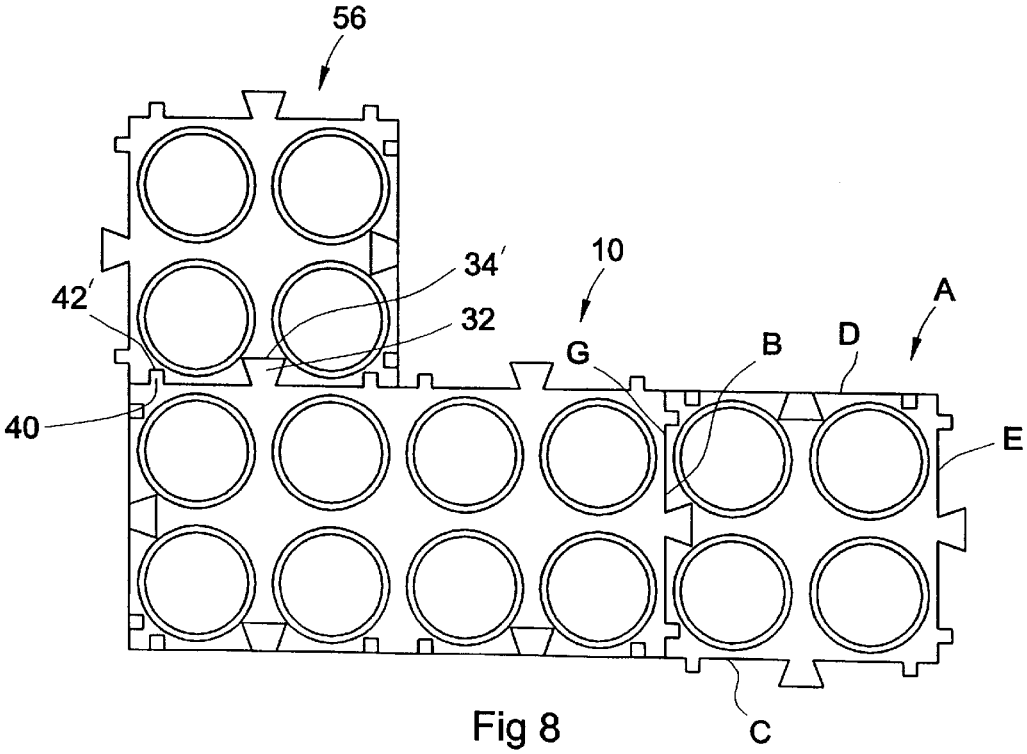
FIG. 8 is a top plan view showing three blocks connected together, forming a corner.

The side-by-side attachment of half-length and full-length blocks is shown in FIGS. 6 and 8. Male dovetail 32' and ribs 40' interfit with female dovetail 34 and grooves 42 respectively of a full length block 10; alternatively, male dovetail 32 and ribs 40 interfit with female dovetail 34' and grooves 42' of a half-length block 56.

Figure 7:
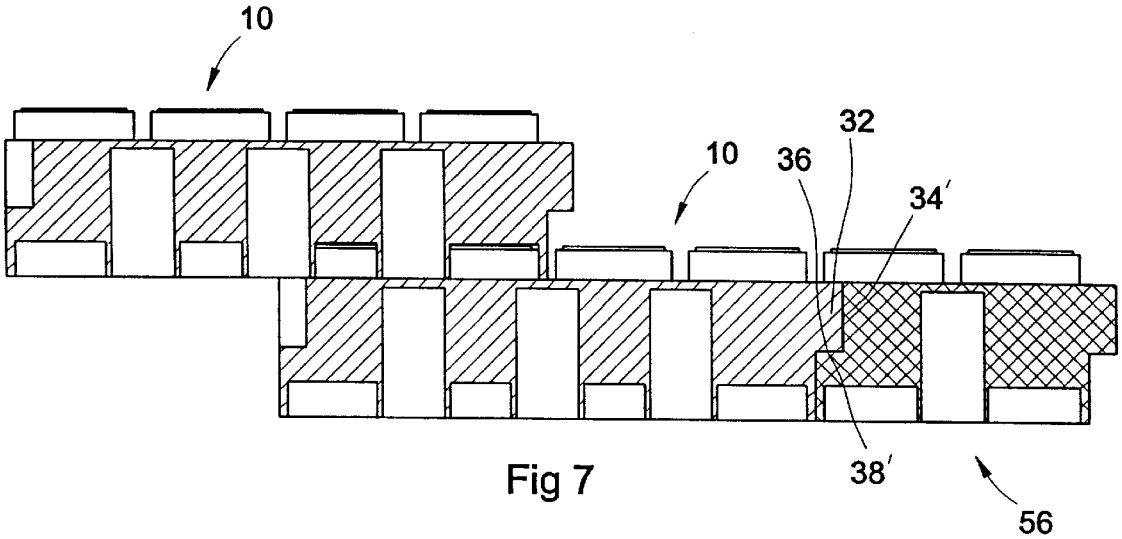
FIG. 7 is a cross-sectional view on the longitudinal mid-line of three blocks connected together.

The side-by-side attachment of blocks is further illustrated in FIG. 7, which is a vertical cross-sectional view through the longitudinal mid-line of the blocks. Male dovetail 32 of block 10 is interlocked with female dovetail 34' of block 56. The lower wall 36 of male dovetail 32 abuts the lower wall 38' of female dovetail 34. This abutment, and the abutment between the lower walls of ribs 40 and grooves 42' prevents block 10 from being moved vertically downward relative to block 56. It is this feature that permits the blocks to be used to build a horizontal structure that spans a space without intermediate support.

The half-length block can be used in a corner location, at the end of a course of blocks, in either of two orientations to permit a second course extending at a right angle from the first course to extend in either of two directions. Referring to FIG. 8, half-length block "A" is attached by female side "B" to male side "G" of block 10, with male side "C" of block "A" facing downwards (in the view of FIG. 8). A course of blocks can be built attached to and extending downward from this male side "C". Alternatively, block "A" can be oriented 90° counterclockwise to the orientation shown in FIG. 8, with female side "D" of block "A" attached to male side "G" of block 10, and a male side of block "A", namely male side "E", facing upwards, such that a course of blocks can be built attached to and extending upward from this side "E". Thus, a wall can be built extending at a right angle in either of two directions from the end of another wall.

Building blocks according to the invention are preferably made of plastic by means of injection molding. Suitable plastics for the toy blocks include polypropylene and ABS; for the construction block, recycled plastic can be used. For use as a toy block, it is contemplated that a full-length building block 10 is approximately 4" in length, 2" in width and ⅞" in height; alternatively, for a larger size toy block, the dimensions are approximately two and one-half times this size. For use as a full-size construction block, it is contemplated that the full-length block 10 is approximately 20" in length, 10" in width and 5½" in height.

As will be apparent to those skilled in the art in the light of the foregoing disclosure, many alterations and modifications are possible in the practice of this invention without departing therefrom. For example, the heights of the male and female dovetails and of the ribs and grooves can be greater or less than that illustrated; they need not extend approximately halfway down the sides of the blocks. The male and female connecting means to attach blocks in vertically adjacent courses can be any of various configurations and need not be the LEGO block-type connectors illustrated herein. The dovetail and rib and groove connectors can be put on only the end walls 20, 22 of the blocks, leaving the two side walls smooth, if it is desired to build walls having smooth surfaces.

What is claimed is:

1. A building block having an upper end, a lower end and first and second pairs of opposed side walls extending between said upper and lower ends, one side wall of each of said pairs of opposed side walls having a male dovetail protruding therefrom, said male dovetail extending generally vertically from said upper end of said building block to a position between said upper end and said lower end of said building block; the opposed side wall of each of said pairs of side walls having a female dovetail therein, said female dovetail extending generally vertically from said upper end of said building block to a position between said upper end and said lower end, said male dovetail and said female dovetail being shaped and configured to interlock with a mating female and male dovetail respectively of adjacent such building blocks with a bottom wall of said male dovetail abutting a bottom wall of said female dovetail, to attach said building blocks together horizontally; said one side wall of each of said pairs of opposed side walls having two ribs protruding therefrom, said ribs being spaced laterally from said male dovetail, one on either side thereof, said ribs extending generally vertically from the upper end of said block to a position between the upper end and the lower end thereof; the opposed side wall of each of said pairs of side walls having two grooves therein, said grooves being spaced laterally from said female dovetail, one on either side thereof, said grooves extending generally vertically from said upper end of said block to a position between said upper end and said lower end, said ribs and grooves being positioned, shaped and configured to interfit with mating grooves and ribs respectively of adjacent said building blocks when said building blocks are attached together horizontally, said ribs and grooves being generally rectangular in shape as viewed from said upper end of said building block; and male connecting means on the upper end of said building block and mating female connecting means on the lower end of said building block adapted for attaching said building block vertically to other said building blocks.

2. A building block according to claim 1 wherein said male connecting means comprises a plurality of posts on the upper end of said block and said female connecting means comprises a plurality of mating recesses in the lower end thereof.

3. A building block having an upper end, a lower end and first and second pairs of opposed side walls extending between said upper and lower ends, one side wall of said first pair of opposed side walls having a male dovetail protruding therefrom, said male dovetail extending generally vertically from said upper end of said building block to a position between said upper end and said lower end of said building block; the opposed side wall of said first pair of opposed side walls having a female dovetail therein, said female dovetail extending generally vertically from said upper end of said building block to a position between said upper end and said lower end, said male dovetail and said female dovetail being shaped and configured to interlock with a mating female and male dovetail respectively of adjacent such building blocks with a bottom wall of said male dovetail abutting a bottom wall of said female dovetail, to attach said building blocks together horizontally; said one side wall of said first pair of opposed side walls having two ribs protruding therefrom, said ribs being spaced laterally from said male dovetail, one on either side thereof, said ribs extending generally vertically from the upper end of said block to a position between the upper end and the lower end thereof; the opposed side wall of said first pair of opposed side walls having two grooves therein, said grooves being spaced laterally from said female dovetail, one on either side thereof, said grooves extending generally vertically from said upper end of said block to a position between said upper end and said lower end, said ribs and grooves being positioned, shaped and configured to interfit with mating grooves and ribs respectively of adjacent said building blocks when said building blocks are attached together horizontally said ribs and grooves being generally rectangular in shape as viewed from said upper end of said building block; and male connecting means on the upper end of said building block and mating female connecting means on the lower end of said building block adapted for attaching said building block vertically to other said building blocks.

4. A building block according to claim 1 or 3 wherein a bottom wall of said ribs abuts a bottom wall of said grooves when said blocks are attached together horizontally.

* * * * *